US006029283A

United States Patent [19]

Comstock et al.

[11] Patent Number: 6,029,283

[45] Date of Patent: Feb. 29, 2000

[54] HELMET HAVING IMPROVED SAFETY FEATURES

[76] Inventors: Scott Patrick Comstock, 10938 Elinda Pl., Sun Valley, Calif. 91352; Kurt Joseph Comstock, 13850 Lakeside St., Sylmar, Calif. 91342

[21] Appl. No.: 09/260,861

[22] Filed: Mar. 1, 1999

Related U.S. Application Data

[63] Continuation of application No. 08/800,472, Feb. 14, 1997, abandoned.

[51] Int. Cl.[7] ..... A42B 3/04

[52] U.S. Cl. ..... 2/422; D2/870; D29/102

[58] Field of Search ..... 2/410, 422, 412, 2/411, 209.13; D2/869, 870, 878, 892, 895; D29/102, 103

[56] References Cited

U.S. PATENT DOCUMENTS

| | | | |
|---|---|---|---|
| D. 382,370 | 8/1997 | Comstock et al. | D2/102 X |
| D. 382,371 | 8/1997 | Comstock et al. | D29/102 X |
| D. 385,063 | 10/1997 | Anderson | D2/102 |
| 3,935,044 | 1/1976 | Daly | 2/412 X |
| 4,106,124 | 8/1978 | Green | 2/422 X |
| 5,508,900 | 4/1996 | Norman | 2/422 |

*Primary Examiner*—Peter Nerbun

*Attorney, Agent, or Firm*—Oppenheimer Wolff & Donnelly, LLP

[57] ABSTRACT

A helmet for use in recreational sporting helmets having a plurality of raised surfaces which are configured to form a fanciful appearance on the external surface of the helmet. Graphical treatment may be applied to enhance the realism of the fanciful appearance. The helmet is attractive to users otherwise perhaps inclined not to wear a helmet during recreational sporting activity.

19 Claims, 7 Drawing Sheets

HELMET HAVING IMPROVED SAFETY FEATURES

RELATED APPLICATIONS

This application is a continuation of U.S. patent application Ser. No. 08/800,472, filed Feb. 14, 1997 now abandoned.

FIELD OF THE INVENTION

The present invention relates to protective safety helmets and particularly to protective recreational sport helmets.

BACKGROUND OF THE INVENTION

Over the last twenty years, the popularity of recreational outdoor sports such as bicycling, in-line skating, rock climbing, skateboarding, etc. has increased dramatically. These activities have become especially popular among youths.

Simultaneous with this rise in popularity has been a corresponding increase in the public awareness of safety issues associated with such sporting activities. One result of this increased awareness has been the advent of protective sport helmets.

Such helmets are typically made of a light yet dense protective material, usually rigid styrene or urethane foam shaped in a generally oval shape to conform with the head of the wearer. Some of the helmets have been designed to include louvers or openings in the helmet to assist in circulating air between the helmet and the wearer's head. In addition, many of the subject helmets have been designed to include colorful graphics to enhance the appearance of the helmets.

A lingering problem with existing helmets, however, is that some individuals are reluctant to wear the protective helmets. Common complaints are that the appearance of the helmets is unattractive or too dull. As a result, significant numbers of individuals are engaging in recreational outdoor sporting activities without wearing a protective helmet. Such individuals are thereby risking unnecessary injury.

In addition to this problem, there is an ongoing goal to increase the protective features of the protective helmets for those who use the helmets. Such improvements are often times constrained by the nature of the helmet design, however. For example, some improvements are impractical since the helmet must remain light enough for the user to wear comfortably. Other improvements are impractical from a manufacturing standpoint. Yet other improvements are simply not cost-effective.

OBJECTS AND SUMMARY OF THE INVENTION

In view of the foregoing, it is an object of the present invention to provide a helmet that addresses the problems and goals associated with the design of existing helmets.

It is a further object of the present invention to provide a helmet with a pleasing appearance that will encourage individuals to use helmets when engaging in sporting activities.

It is a further object of the present invention to provide a helmet with a fanciful appearance that is appealing.

It is a further object of the present invention to provide a helmet with improved safety features.

These and other objects not specifically enumerated are believed to be accomplished with a helmet in accordance with the present invention which may include an inner core sized to receive a user's head and an overlay fixed to the inner core. The inner core and the overlay may form an external helmet surface with a contour having a plurality of raised surfaces. In addition, a graphic treatment may be applied to the external surface such that the combination of the plurality of raised surfaces and the graphic treatment forms an external surface on the helmet with a fanciful appearance.

DESCRIPTION OF THE DRAWING FIGURES

The present invention may be better understood and the advantages will become apparent to those skilled in the art by reference to the accompanying drawings, wherein like reference numerals refer to like elements in the several figures, and wherein.

DESCRIPTION OF PREFERRED EMBODIMENTS

Figure 1:
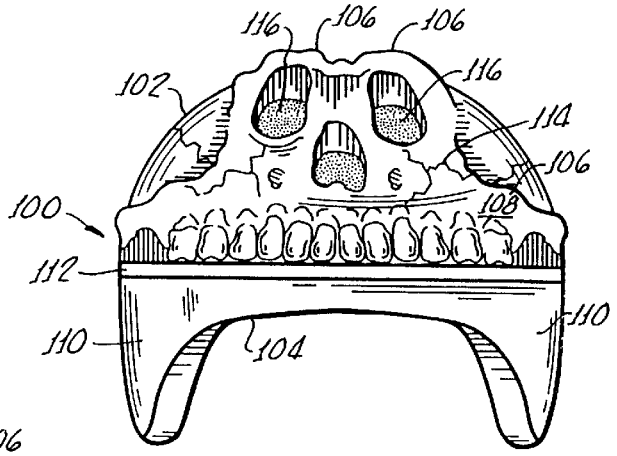
FIG. 1 is a front elevational view of a first embodiment of the present invention.
Figure 2:
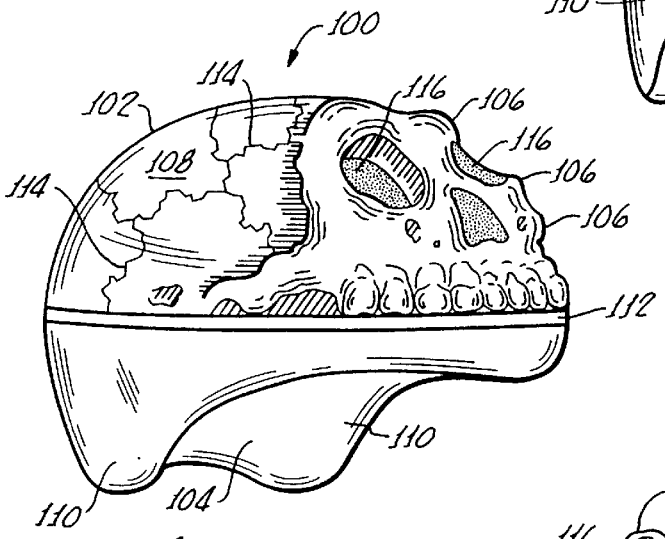
FIG. 2 is a side elevational view of the present invention as set forth in FIG. 1
Figure 3:
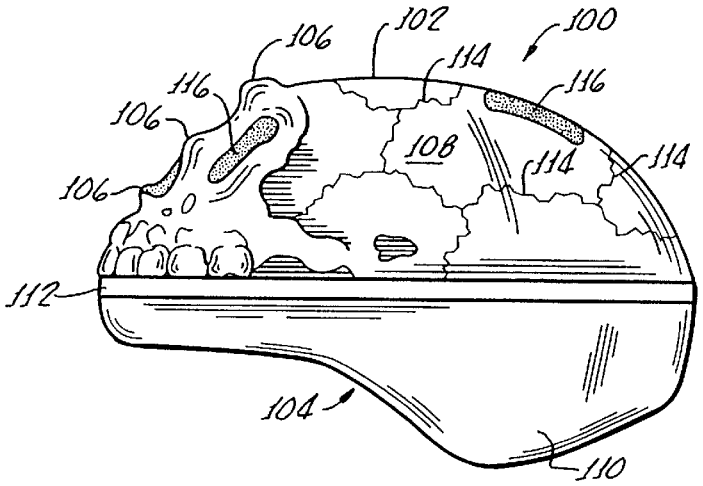
FIG. 3 is a side elevational view opposite to the view in FIG. 2

Referring to FIGS. 1–3, a helmet 100 in accordance with the present invention has the same general shape of existing helmets, namely a generally curved outside top surface and lower wing members 110 extending below a midline 112 in the helmet 100 and to the rear of the helmet 100. The interior surface 104 of the helmet is shaped to conform generally to the rounded surface of a user's head (not shown).

The exterior surface 102 of the present invention is contoured such that it has a plurality of raised surfaces 106 such as mounds or bumps extending outwardly from the helmet 100. More particularly, these raised surfaces 106 are positioned on the exterior surface 102 of the helmet 100 in a manner such that the overall configuration of the raised surfaces 106 yields an exterior surface 102 that strongly resembles the outward contour of a human skull.

In addition to the configuration of raised surfaces 106, the exterior surface 102 of the helmet 100 includes a graphic treatment 108 to enhance the realism of the human skull appearance. More specifically, the graphic treatment 108 includes colored shading 116 in what would correspond to the recessed cranial regions of a human skull and lines 114 to depict the cranial lines found on a human skull. It is appreciated that any other type of graphic treatment could be used to further enhance the human skull appearance.

Figure 4:
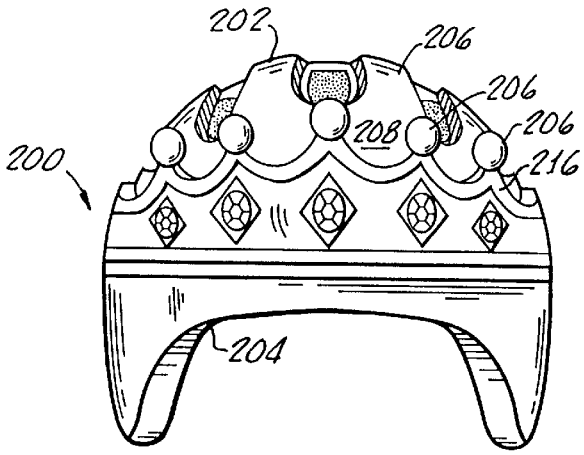
FIG. 4 is a front elevational view of a second embodiment of the present invention.
Figure 5:
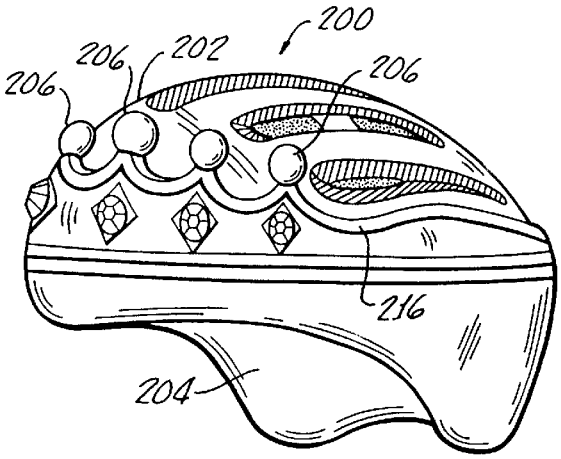
FIG. 5 is a side elevational view of the present invention as set forth in FIG. 4.
Figure 6:
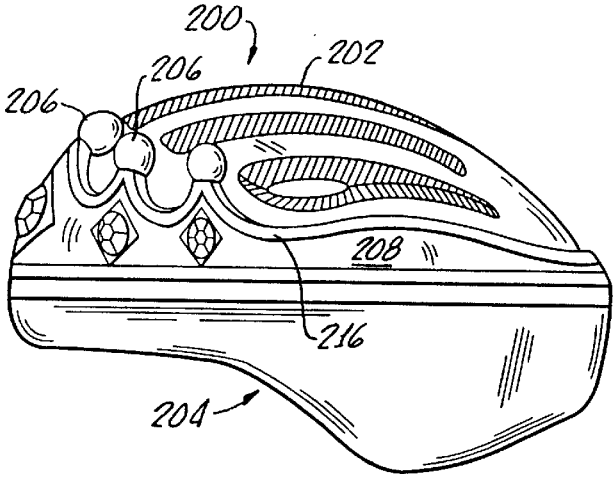
FIG. 6 is a side elevational view opposite to the view in FIG. 5.

Referring to FIGS. 4–6, a helmet 200 in accordance with a second embodiment of the present invention similarly includes an exterior surface 202 and an interior surface 204. The exterior surface includes raised surfaces 206 that are positioned on the exterior surface 202 in a manner such that the overall configuration of the raised surfaces yields an exterior surface 202 that strongly resembles a jeweled crown.

In addition to the configuration of raised surfaces 206, the exterior surface 202 of the helmet 200 includes a graphic treatment 208 to enhance the realism of the jeweled crown appearance. More specifically, the graphic treatment 208 includes adding a color 216 to, e.g., a rimmed surface or a jewel, of the crown. It is appreciated that any other type of graphic treatment could be used to further enhance the jeweled crown appearance.

Figure 7:
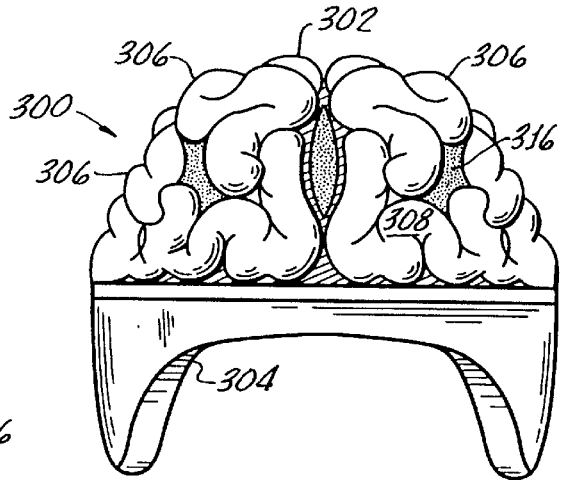
FIG. 7 is a front elevational view of a third embodiment of the present invention.
Figure 8:
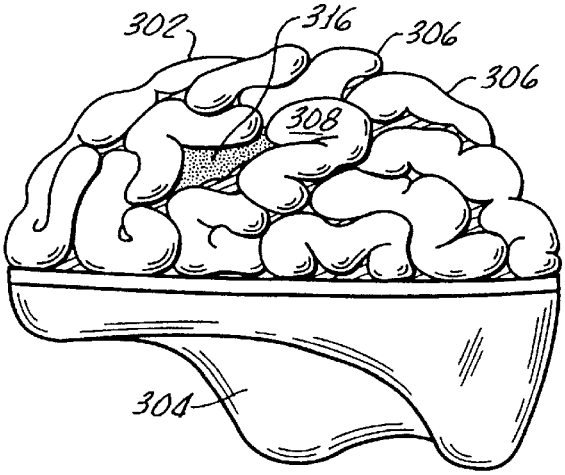
FIG. 8 is a side elevational view of the present invention as set forth in FIG. 7.
Figure 9:
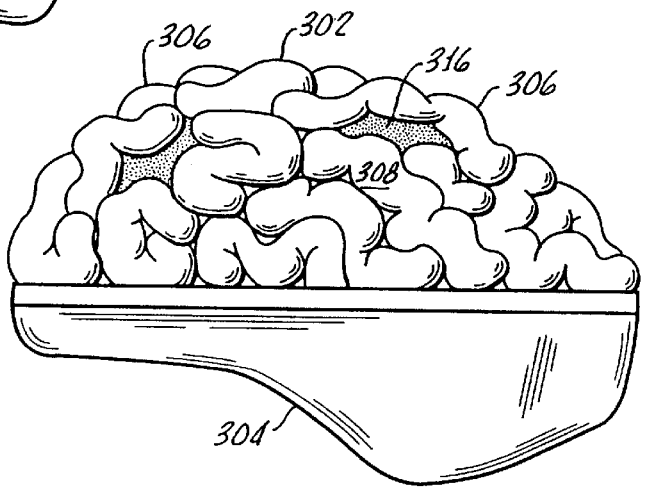
FIG. 9 is a side elevational view of the present invention as set forth in FIG. 8.

Referring to FIGS. 7–9, a helmet 300 in accordance with a third embodiment of the present invention similarly includes an exterior surface 302 and in interior surface 304. The exterior surface includes raised surfaces 306 that are positioned on the exterior surface 302 in manner such that the overall configuration of the raised surfaces yields an exterior surface 302 that strongly resembles a human brain.

In addition to the configuration of raised surfaces 306, the exterior surface 302 of the helmet 300 includes a graphic treatment 308 to enhance the realism of the human brain appearance. More specifically, the graphic treatment 308 includes adding a colored shading 316 to lower tissue areas of the brain. It is appreciated, however, that any other type of graphic treatment could be used to further enhance the human brain appearance.

The appearance of a human skull, jeweled crown, human brain, or any other fanciful appearance on the exterior surface of the helmet as formed by the raised surfaces and the graphic treatment, causes the helmet in accordance with the present invention to be more interesting and novel and therefore more attractive to users who may otherwise decline to wear a helmet. This is especially so with some users who may only wear a helmet if the helmet is distinctive and unique in appearance. As such, the human skull appearance, or any other fanciful appearance, on the exterior surface of the helmet serves to encourage the general safety of those who participate in recreational sport activities.

Figure 10:
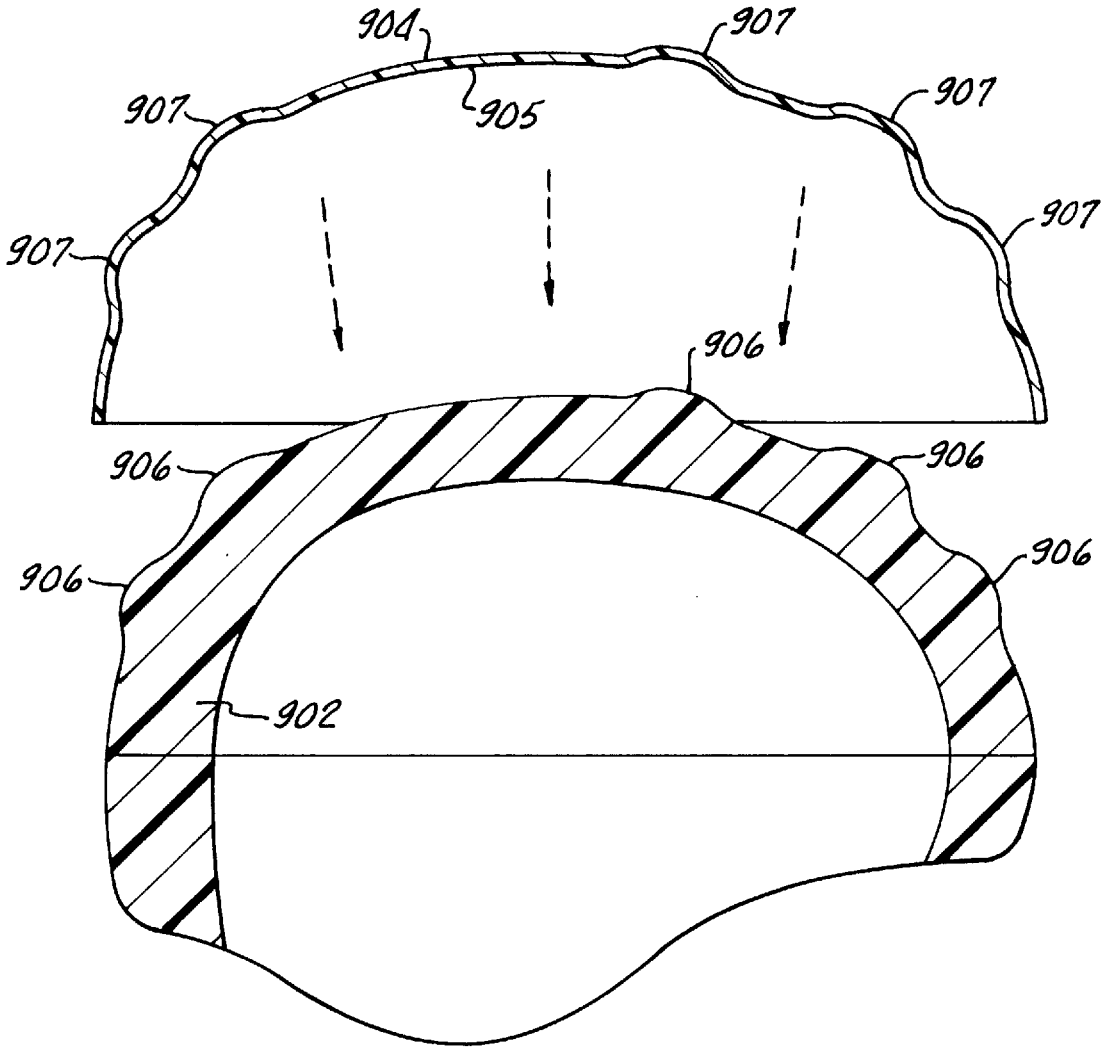
FIG. 10 is an assembly drawing of a helmet in accordance with the present invention.

Referring to FIG. 10, the specific structure of a helmet 900 in accordance with the present invention will be described. The helmet 900 is constructed essentially as an assembly of a inner core 902 (usually a foam) and a clear graphic overly 904 which are laminated together with an adhesive process known to those skilled in the art. The graphic overly 904 is usually made of a plastic or vinyl or styrene material and typically has a thickness in the range of 0.01 to 0.02 inches. Further, the graphic overlay 904 is formed to nest evenly and closely with the inner core 902.

The inner core 902 has a top surface which includes raised surfaces 906 which are configured to form the fanciful appearance as discussed previously. The graphic overly 904 includes corresponding raised surfaces 907 which mate with the raised surfaces 906 of the inner core 902 when the two pieces are mated together to form the finished helmet 900.

The graphic overlay 904 is typically configured to contain the previously discussed graphical treatment which serves to enhance the realism of the fanciful appearance on the external surface of the helmet 900. For example, the color and detailed graphics may be applied with known techniques to the underside 905 of the clear overlay 904. As a result, the graphics of the helmet are protected from damage once the overlay 904 is mounted on the inner core 902.

Figure 11:
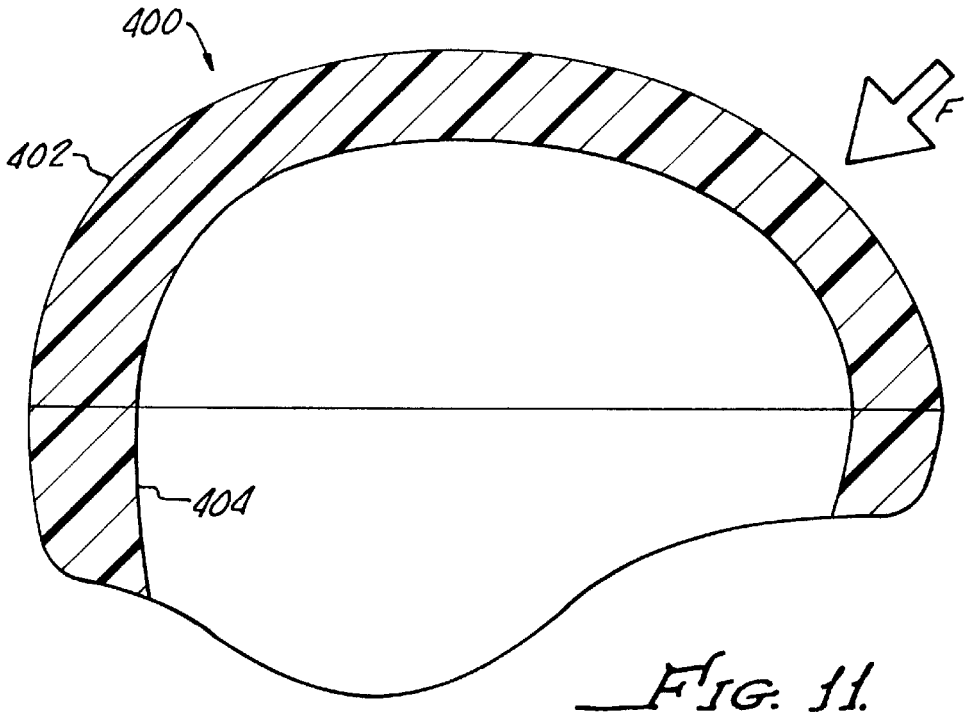
FIG. 11 is a cross-sectional view of a prior art helmet.
Figure 12:
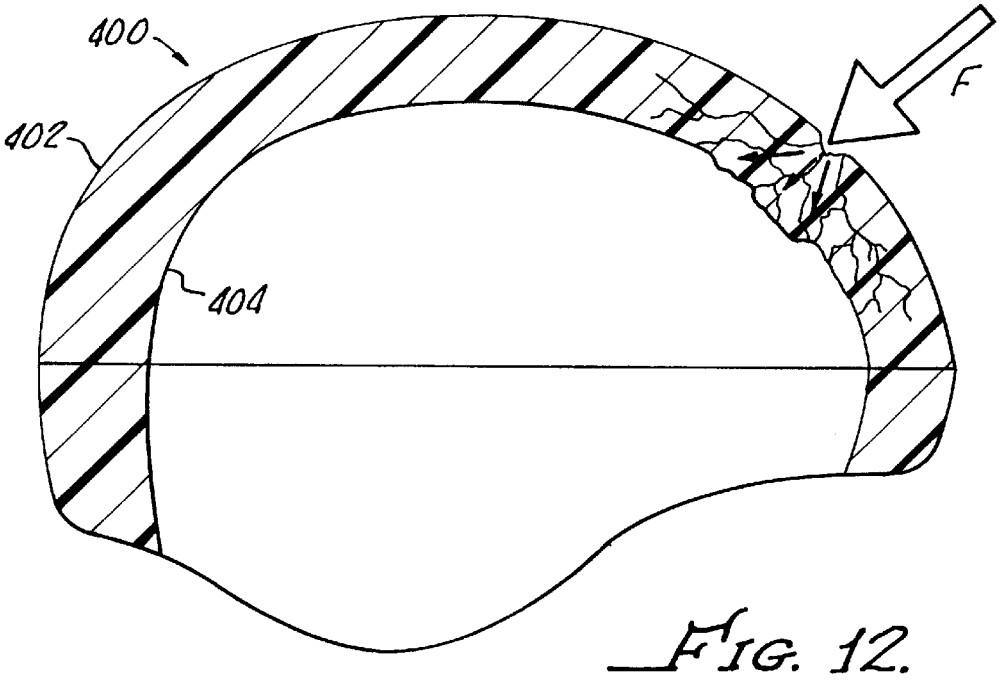
FIG. 12 is a cross-sectional view of a prior art helmet.

A helmet in accordance with the present invention also yields improved safety over conventional helmets. For example, referring to FIGS. 11 and 12, in many conventional helmets 400, the exterior surface 402 is a smooth rounded surface. Consequently, when a force F resulting either from a fall by the user or by the impact of an external object impacts the helmet, there is little dispersion of the impact force through the structure of the helmet layer. Consequently, the head of the user is potentially more vulnerable to injury.

Figure 13:
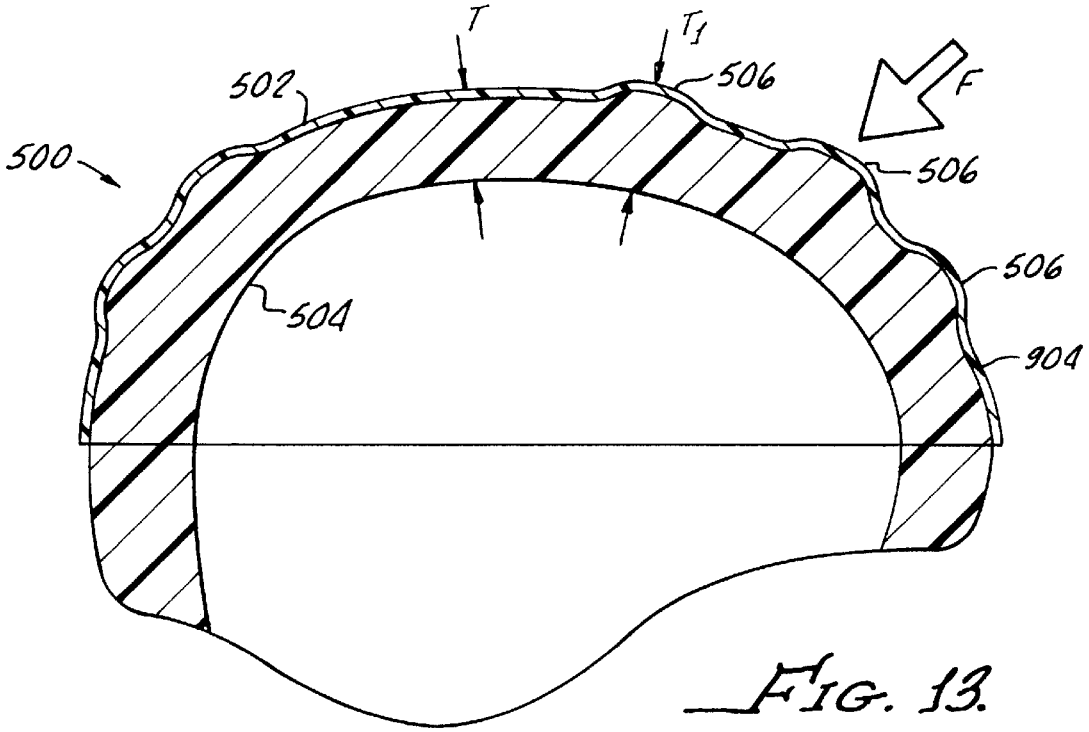
FIG. 13 is a cross-sectional view of a helmet in accordance with the present invention.
Figure 14:
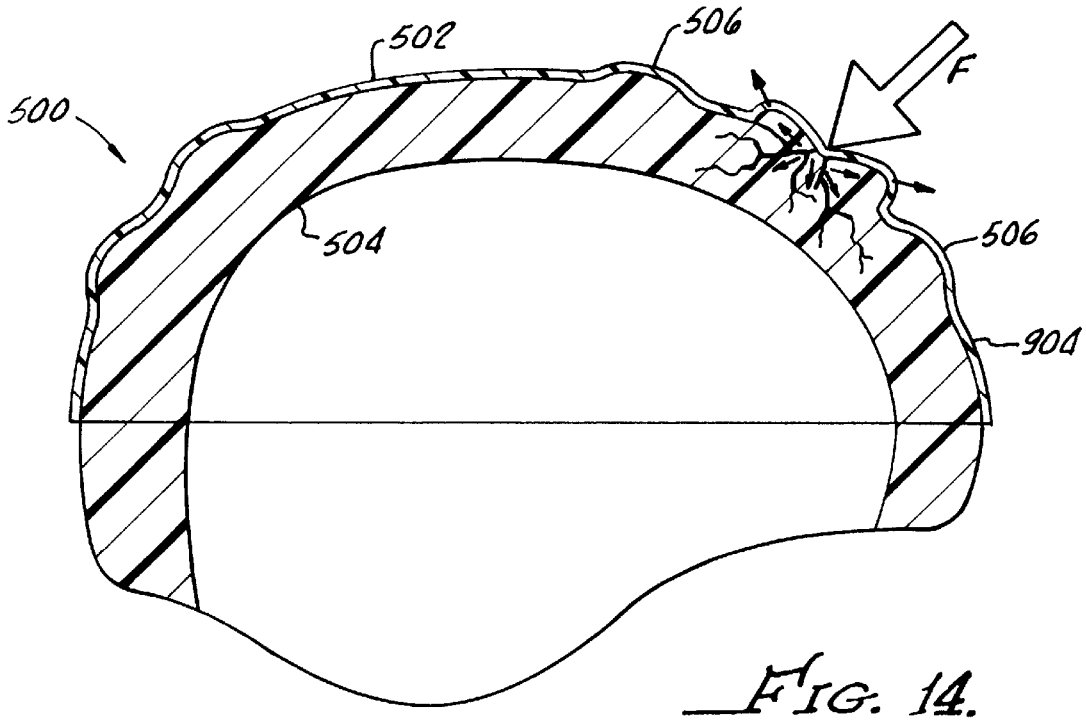
FIG. 14 is a cross-sectional view of a helmet in accordance with the present invention.

Referring to FIGS. 13 and 14, a helmet 500 in accordance with the present invention, however, includes the raised surfaces 506 as discussed above. Consequently, when a force F resulting from a fall by the user or by the impact of an external object impacts the helmet 500, there is a greater likelihood that the force will be dispersed through a greater amount of material in the helmet before the destructive force reaches the head of the user, which is resting on the inside surface 504. Consequently, the helmet 500 in accordance with the present invention potentially offers greater safety than conventional helmets.

With further reference to FIG. 13, it is appreciated that the helmet in accordance with the present invention has a mean thickness T of approximately 0.75 inches. The raised surfaces 506 of the invention have a thickness T1 which is greater than the mean thickness T of the helmet 500 by an amount in the range of 1.1 to 2.0 times the mean thickness.

Figure 16B:
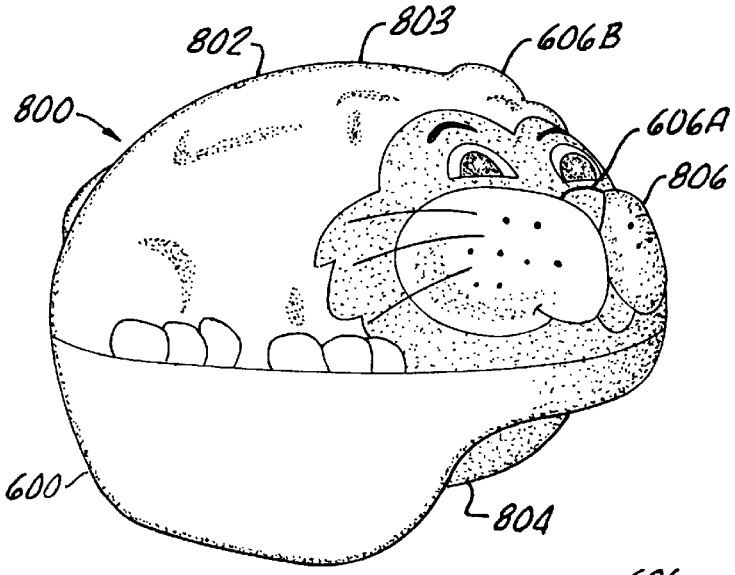
FIG. 16A is a plan view of an additional embodiment of a helmet in accordance with the present invention; and, FIG. 16B is a plan view of an additional embodiment of a helmet in accordance with the present invention.
Figure 15:
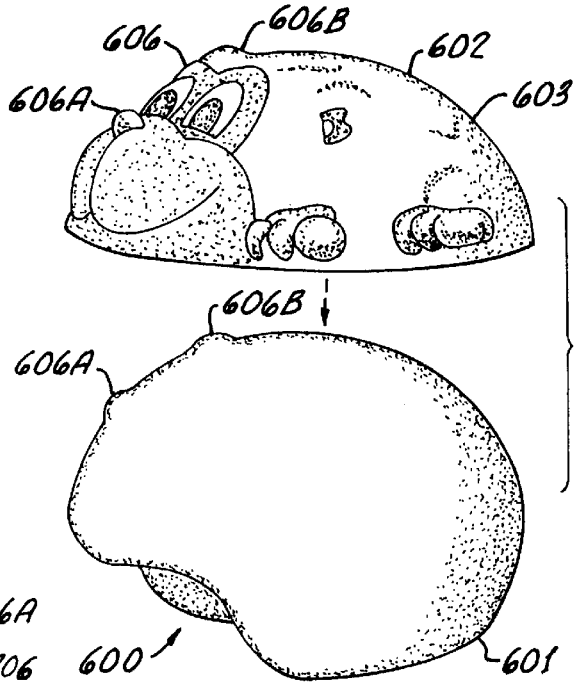
FIG. 15 is an assembly drawing of an additional embodiment of a helmet in accordance with the present invention.
Figure 16A:
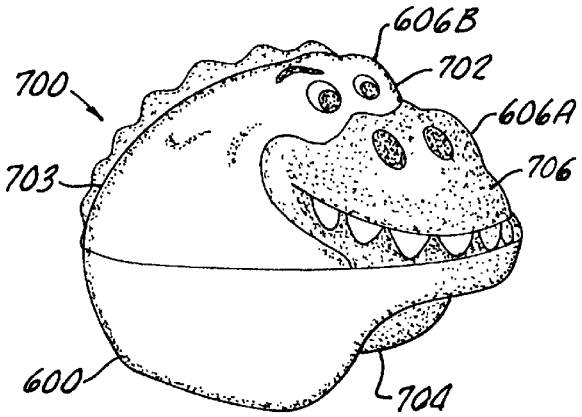

Referring to FIGS. 15, 16A and 16B, a helmet in accordance with the present invention may have features useful in the manufacture of the helmet. For example, the helmet may be comprised of a molded inner core 600 which serves as a platform for a plurality of interchangeable graphic overlays, 603, 703, 803. The inner core member 603 includes raised surfaces 606 on its external surface 602 that create an overall configuration that may be used for a plurality of different fanciful appearances. For example, the raised surfaces 606A, 606B of the inner core 600 may be used to correspond with the raised surfaces 606A, 606B of a puppy overlay 603, a cat overlay 803 or a dinosaur overlay 703. As a result, one configuration of an inner core may be used for a plurality of different overlays. This results in reduced tooling costs. As discussed previously, a graphical treatment is also used on each overlay to enhance the realism of the fanciful appearance such as coloring the nose or shading the areas of the ears or eyes.

The foregoing is a description of the preferred exemplary embodiments and best mode of the invention contemplated by the inventor at the time of filing the application. The invention is not limited to the specific embodiments shown. Rather, the scope of the invention is expressed in the appended claims.

What is claimed is:

1. A helmet comprising:

an inner core having an inner surface and an outer surface above said inner surface;

said inner surface sized to receive a wearer's head;

said outer surface having a contour with a plurality of raised surfaces to form an overall configuration resembling a fanciful appearance;

a clear overlay having an inner surface and an outer surface, said overlay fixed to said outer surface of said inner core; and a graphic treatment on said inner surface of said overlay, said overlay being a substantially clear layer such that said graphic treatment is visible through said clear layer, said graphic treatment enhancing the realism of said fanciful appearance, and said clear layer protecting said graphic treatment from damage.

2. A helmet in accordance with claim 1, wherein said fanciful appearance is internal anatomy of the human body.

3. A helmet in accordance with claim 2, wherein said fanciful appearance is a human brain.

4. A helmet in accordance with claim 2, wherein said fanciful appearance is a human skull.

5. A helmet in accordance with claim 1, wherein said fanciful appearance is an imaginary animal.

6. A helmet in accordance with claim 5, wherein said imaginary animal is any one of an imaginary dinosaur or imaginary house pet.

7. A safety helmet comprising:

a shell having an inner surface and an outer surface;

said shell having a mean thickness;

said shell having an external contour containing a plurality of raised surfaces to form an overall configuration resembling a fanciful appearance, each of said plurality of raised surfaces having a thickness that is greater than the mean thickness of said shell within a range of 1.1 to 2.0 times the mean thickness;

a clear overlay having an inner surface and an outer surface, said overlay mounted on said external contour of said shell; and a graphic treatment on said inner surface of said overlay, said overlay being a substantially clear layer such that said graphic treatment is visible through said clear layer, said graphic treatment enhancing the realism of said fanciful appearance, and said clear layer protecting said graphic treatment from damage.

8. A safety helmet in accordance with claim 7, wherein said fanciful appearance is internal anatomy of the human body.

9. A safety helmet in accordance with claim 8, wherein said fanciful appearance is a human brain.

10. A safety helmet in accordance with claim 8, wherein said fanciful appearance is a human skull.

11. A safety helmet in accordance with claim 7, wherein said fanciful appearance is an imaginary animal.

12. A safety helmet in accordance with claim 11, wherein said imaginary animal is any one of an imaginary dinosaur or imaginary house pet.

13. A helmet comprising:

a shell having an inner surface and an external surface above said inner surface;

said inner surface sized for receiving a wearer's head;

said external surface having a fanciful shape;

said fanciful shape formed from a plurality of impact dispersing raised surfaces distributed on said external surface;

a clear overlay having an inner surface and an external surface, said overlay fixed to said external surface of said inner core; and a graphic treatment on said inner surface of said overlay, said overlay being a substantially clear layer such that said graphic treatment is visible through said clear layer, said graphic treatment enhancing the realism of said fanciful appearance, and said clear layer protecting said graphic treatment from damage.

14. A helmet in accordance with claim 13, wherein said fanciful shape is internal anatomy of the human body.

15. A helmet in accordance with claim 14, wherein said fanciful shape is a human brain.

16. A helmet in accordance with claim 14, wherein said fanciful shape is a human skull.

17. A helmet in accordance with claim 13, wherein said fanciful shape is an imaginary animal.

18. A helmet in accordance with claim 17, wherein said imaginary animal is any one of an imaginary dinosaur or imaginary house pet.

19. A helmet in accordance with claim 13, wherein said helmet further comprises an overlay selected from a plurality of interchangeable overlays, wherein each of said interchangeable overlays has a surface conforming substantially with at least a portion of said raised surfaces forming said fanciful shape, and is interchangeable with at least one alternative overlay.

* * * * *